US007931521B1

(12) United States Patent
Griffin

(10) Patent No.: US 7,931,521 B1
(45) Date of Patent: Apr. 26, 2011

(54) ADJUSTABLE BRA STRAP

(76) Inventor: Sheila K Griffin, Peoria, AZ (US)

( * ) Notice: Subject to any disclaimer, the term of this patent is extended or adjusted under 35 U.S.C. 154(b) by 434 days.

(21) Appl. No.: 12/122,144

(22) Filed: May 16, 2008

Related U.S. Application Data

(60) Provisional application No. 60/938,413, filed on May 16, 2007.

(51) Int. Cl.
*A41C 3/00* (2006.01)

(52) U.S. Cl. ..... 450/86; 2/336; 2/912; 2/913

(58) Field of Classification Search ..... 450/86, 450/88, 1; 2/113–115, 73, 78.1–78.4, 105, 2/106, 336, 912, 913
See application file for complete search history.

(56) References Cited

U.S. PATENT DOCUMENTS 4,781,651 A * 11/1988 Ekins ..... 450/79
5,951,364 A * 9/1999 Brown et al. ..... 450/1
6,165,045 A * 12/2000 Miller et al. ..... 450/1
6,168,498 B1 * 1/2001 Wagner ..... 450/58

* cited by examiner

*Primary Examiner* — Gloria Hale
(74) *Attorney, Agent, or Firm* — Snell & Wilmer L.L.P.

(57) ABSTRACT

In combination with a bra having a front anchor strap portion and a rear anchor strap portion, an adjustable bra strap includes an elongated enclosed loop of flexible fabric with one end forming an attachment section. One end of the enclosed loop is coupled to the rear anchor strap portion and the other end is coupled to the front anchor strap portion. The enclosed loop extends through a first coupler with the attached coupler being movable longitudinally along one side of the enclosed loop. An element of a fastener is affixed to the attachment section and a complemental element is affixed to a facing portion of the enclosed loop. The element is positioned to mate with and releasably connect to the complement element in a selected orientation.

8 Claims, 4 Drawing Sheets

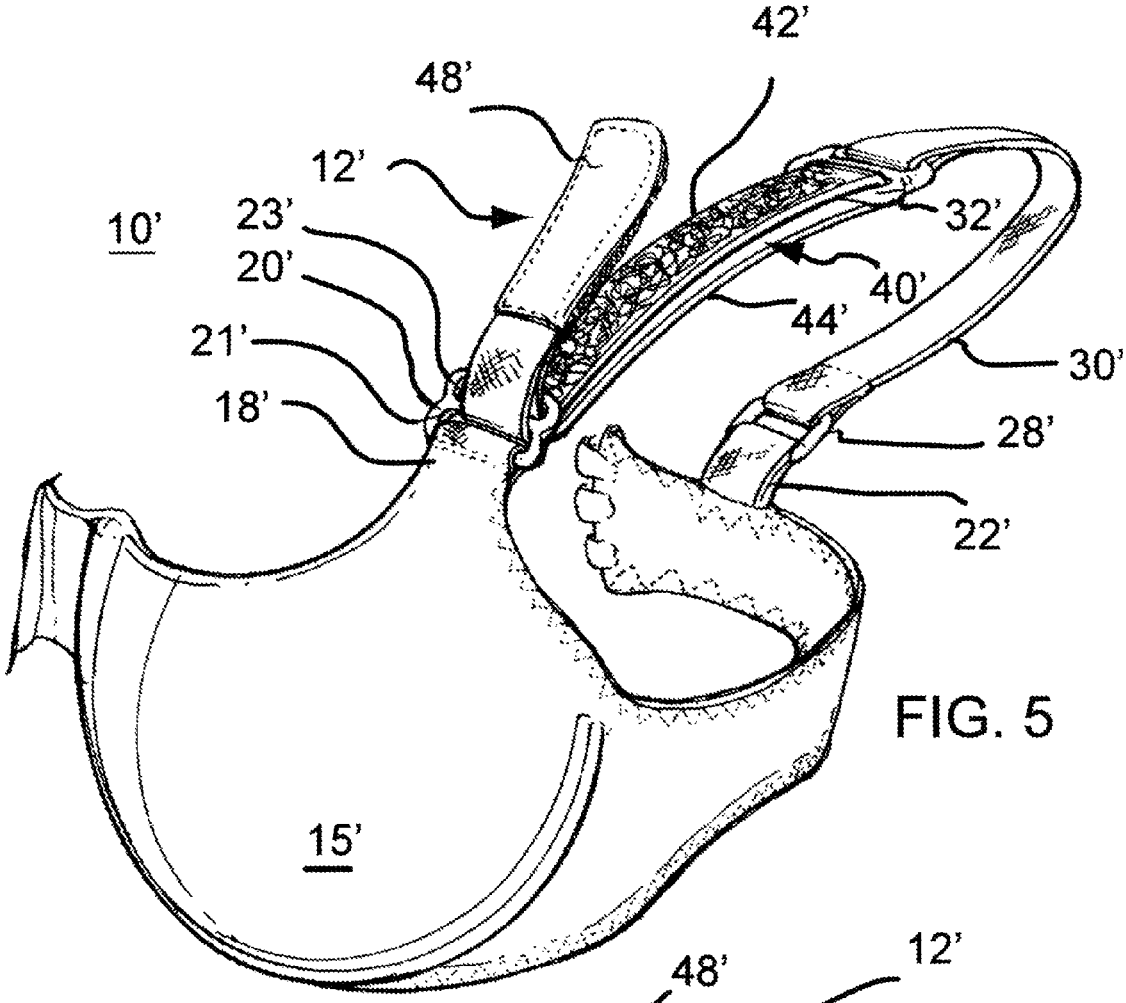
FIG. 5
FIG. 6
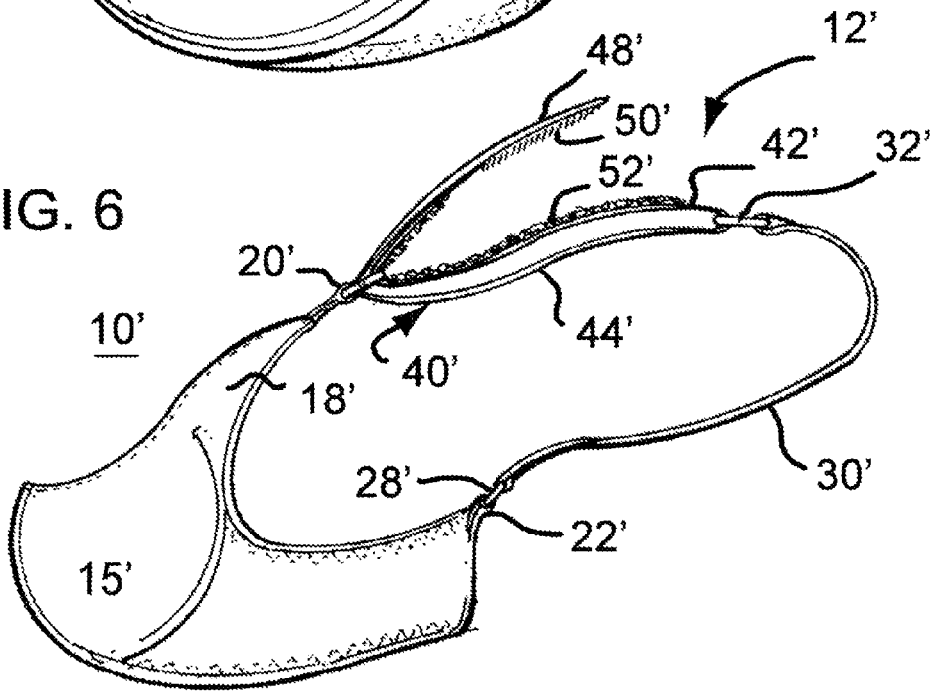

ADJUSTABLE BRA STRAP

CROSS-REFERENCE TO RELATED APPLICATION

This application claims the benefit of U.S. Provisional Application No. 60/938,413, filed May 16, 2007.

FIELD OF THE INVENTION

This invention generally relates to women's brassieres or 'bras' and more specifically to adjustable straps for use on a bra.

BACKGROUND OF THE INVENTION

In many instances bras have a tendency to loosen, change shape, or become repositioned so that they are uncomfortable and can actually cause some harm or sore areas. This is especially true for the highly active women in today's society. Also, after a bra is used for longer periods of time, washed, etc. it can stretch or otherwise lose its shape.

In some instances a resilient or elastic strip of material is included in the bra strap to provide a continuous upward bias. The problem with this solution is that the elastic wears rapidly and with each washing and wearing substantially changes its tension.

While most bras have an adjustable clip in each of the straps, adjusting this clip is difficult and must be accomplished strictly by trial and error. That is, because the clips are in the back and can't be reached while the bra is on, the clips are adjusted while the bra is off and then the woman tries the bra on to see if the adjustment was correct. Further, these clips can slip slightly so that over time the bra can become loose enough to be uncomfortable.

It would be highly advantageous, therefore, to remedy the foregoing and other deficiencies inherent in the prior art.

Accordingly, it is an object of the present invention to provide a new and improved adjustable bra strap.

Another object of the invention is to provide a new and improved adjustable bra strap that is convenient to adjust.

Another object of the invention is to provide a new and improved adjustable bra strap that is easily accessible and can be adjusted easily and virtually unnoticeably.

SUMMARY OF THE INVENTION

Briefly, to achieve the desired objects of the instant invention in accordance with a preferred embodiment thereof, an adjustable bra strap is provided in combination with a bra having a front anchor strap portion and a rear anchor strap portion. The adjustable bra strap includes an elongated enclosed loop of flexible fabric having a first end and a second end with one of the first end and the second end forming an elongated attachment section. A first coupler couples one of the first end and the second end of the elongated enclosed loop to the rear anchor strap portion and a second coupler couples another of the first end and the second end of the elongated enclosed loop to the front anchor strap portion. The elongated enclosed loop extends through one of the first coupler and the second coupler with the one of the first coupler and the second coupler being movable longitudinally along one side of the elongated enclosed loop at least partially between the first end and the second end. An element of a fastener is carried by the attachment section and a complemental element is carried by a facing portion of the elongated enclosed loop. The attachment section of the elongated enclosed loop is positioned adjacent one of the first coupler and the second coupler, the element being positioned to mate with and releasably connect to the complemental element in a selected orientation on an opposing side of one of the first coupler and the second coupler.

Briefly, the desired objects of the instant invention are further achieved in accordance with a specific embodiment in which an adjustable bra strap is combined with a bra having a front anchor strap portion and a rear anchor strap portion. An elongated enclosed loop of flexible fabric has a first end and a second end with one of the first end and the second end forming an elongated attachment section. An elongated strap portion couples a first coupler to the rear anchor strap portion so as to position the first coupler in front of a wearer's shoulder. The first coupler couples the first end of the elongated enclosed loop to the elongated strap portion. A second coupler couples the second end of the elongated enclosed loop to the front anchor strap portion. The elongated enclosed loop extends through one of the first coupler and the second coupler with the one of the first coupler and the second coupler being movable longitudinally along one side of the elongated enclosed loop at least partially between the first end and the second end. An element is carried by the attachment section and a complemental element is carried by a facing portion of the elongated enclosed loop. The attachment section of the elongated enclosed loop is positioned adjacent one of the first coupler and the second coupler, the element being positioned to mate with and releasably connect to the complemental element in a selected orientation on an opposing side of one of the first coupler and the second coupler. The selected orientation is changed by longitudinal movement of the one of the first coupler and the second coupler along one side of the elongated enclosed loop.

The objects and advantages are also provided by a bra having a front anchor strap portion and a rear anchor strap portion, and an elongated enclosed loop of flexible fabric having a first end and a second end. The first end forms an attachment section and an elongated strap portion extends from the second end of the elongated enclosed loop. The elongated strap portion couples the second end of the elongated enclosed loop to rear anchor strap portion. A coupler couples the first end of the elongated enclosed loop to the front anchor strap portion. The elongated enclosed loop extends through the coupler with the coupler being movable longitudinally along one side of the elongated enclosed loop at least partially between the first end and the second end. An element is carried by the attachment section and a complemental element is carried by a facing portion of the elongated enclosed loop. The attachment section of the elongated enclosed loop is positioned on one side of the coupler, the element being positioned to mate with and releasably connect to the complemental element in a selected orientation on an opposing side of the coupler. The selected orientation is changed by longitudinal movement of the coupler along one side of the elongated enclosed loop.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which:

FIG. 5 is an enlarged partial side view in perspective of another embodiment of a bra, in accordance with the present invention, portions thereof removed, illustrating in detail the adjustment mode;

FIG. 6 is an enlarged side view of one of the adjustable straps, as seen in FIG. 5.

DETAILED DESCRIPTION OF A PREFERRED EMBODIMENT

Figure 1:
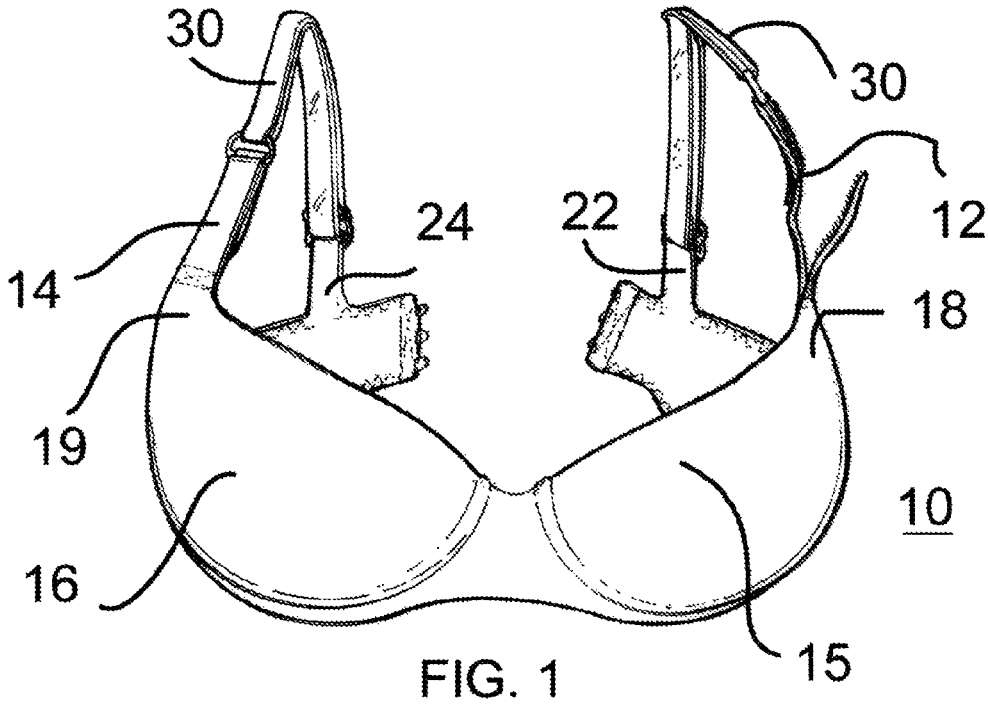
FIG. 1 is front view of a bra including adjustable straps in accordance with the present invention.
Figure 2:
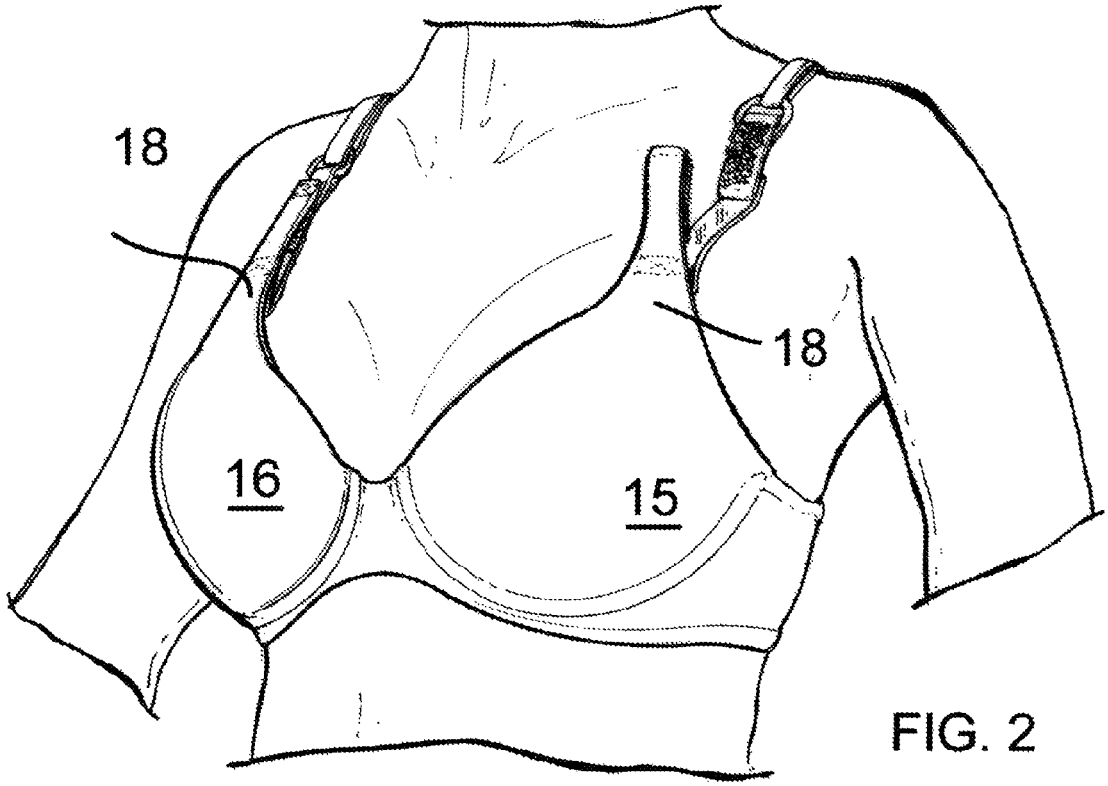
FIG. 2 is a front perspective view of the bra of FIG. 1 in a partial readjustment mode.

Turning now to the drawings, attention is first directed to FIG. 1 which illustrates a bra 10 including adjustable bra straps 12 and 14, in accordance with the present invention. It will be understood that a large variety of shapes and constructions of bras is available and the present bra 10 is used for illustrative purposes only. At an upper edge of each cup 15 and 16 front anchor strap portions 18 and 19, respectively, extend upwardly toward the top of each shoulder. Similarly, in the back rear anchor strap portions 22 and 24 extend upwardly along the back toward the top of the shoulder.

Figure 4:
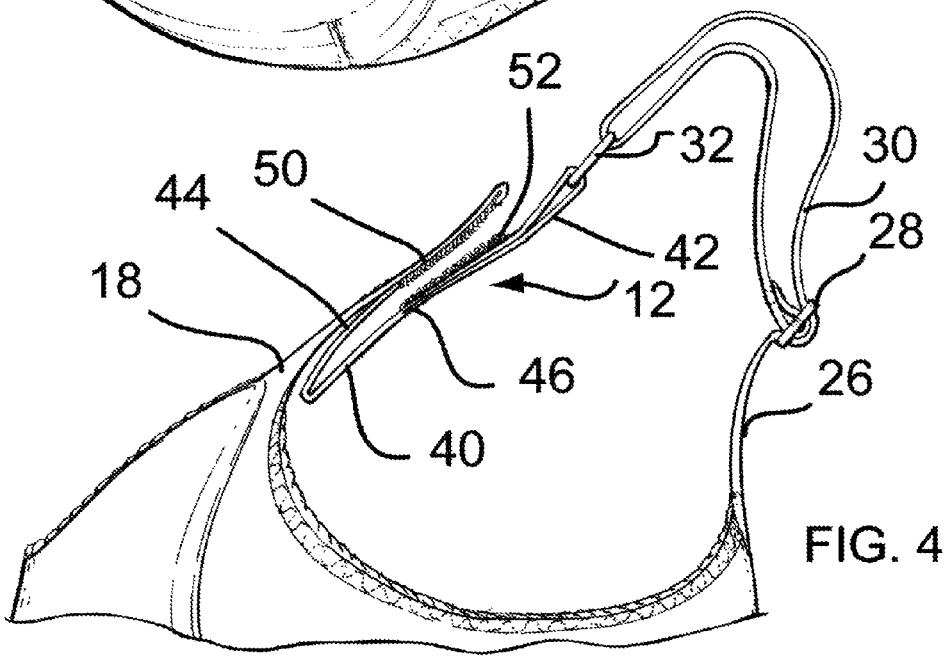
FIG. 4 is an enlarged side view of one of the adjustable straps, as seen in FIG. 3.

As illustrated best in FIG. 4, in this preferred embodiment rear anchor strap portions 22 and 24 typically include elongated strap portions 26 that extend through a clip 28 several times to form a loop 30. Loop 30 can be changed in size/length by moving elongated strap portions 26 through clip 28 in different directions, in a well known manner. While elongated strap portions 26 are illustrated as a preferred embodiment, it will be understood that in a different embodiment clip 28 might be fixedly attached to portion 26 at or near the position illustrated and loop 30 might be a separate strap portion. In many prior art bras, front anchor strap portion 18 is extended a longer distance and loop 30 is connected directly to an upper end of front anchor strap portion 18 by some apparatus, such as a ring 32. In some prior art bras a portion of the strap between loop 30 and front anchor strap portion 18 is made of elastic material.

Figure 3:
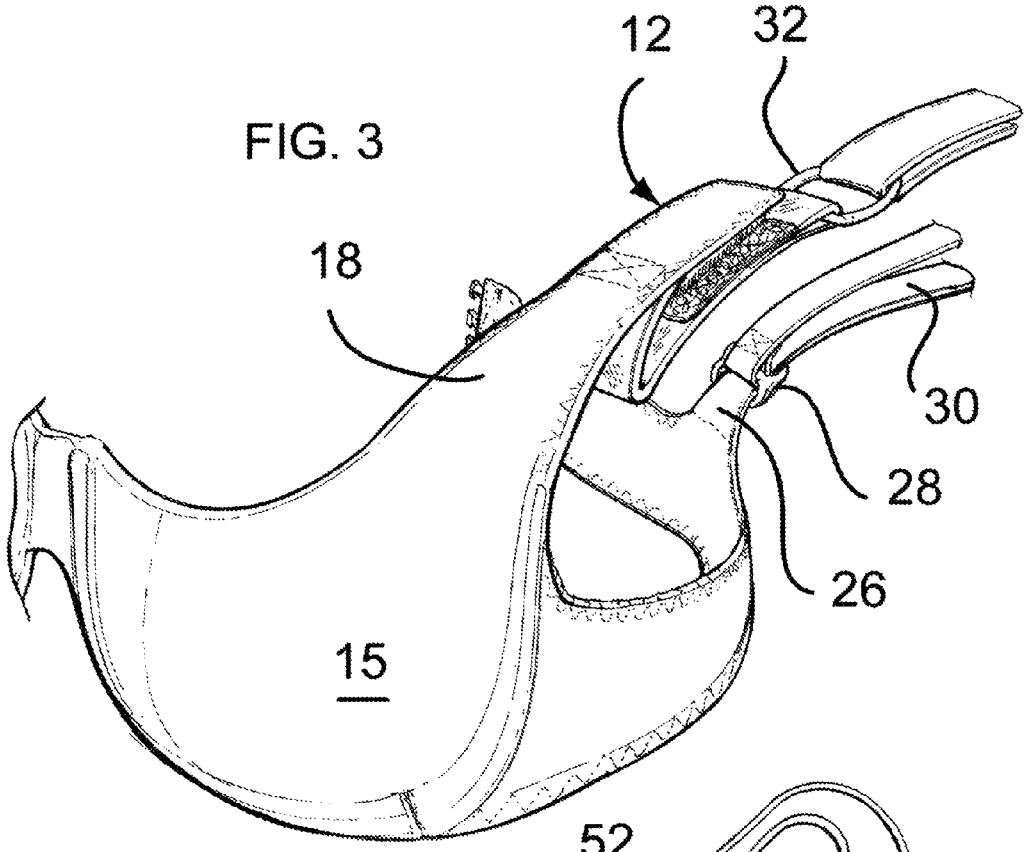
FIG. 3 is an enlarged partial side view in perspective of the bra of FIG. 1, portions thereof removed, illustrating in more detail the adjustment mode.

For simplicity of understanding only the left bra strap (right-hand bra strap in the frontal view figures) is illustrated in FIGS. 3 and 4 and only the left bra strap will be discussed in detail with the understanding that the right bra strap is identical. In the present invention adjustable strap 12 is positioned between front anchor strap portion 18 and loop 30. Further, in this preferred embodiment adjustable strap 12 is fixedly attached to anchor strap portion 18 but in other embodiments could be attached by means of rings or clips. It will be understood that adjustable strap 12 could be constructed in a variety of different embodiments, and the embodiment illustrated and described, while having some manufacturing and comfort advantages, is primarily for purposes of explanation.

In this embodiment, adjustable strap 12 is formed as an elongated strap 40 with an upper end portion 42 and a lower end 44. Upper end portion 42 of elongated strap 40 is fold through ring 32 and attached back on itself to form a connecting loop. Upper end portion 42 may be formed as a continuous part of a midsection 46 of elongated strap 40 or as a separate strap attached to midsection 46 of elongated strap 40 by any conventional method, such as sewing, heat bonding, adhesive, or the like. Alternatively, elongated strap 40 can be formed integral with or attached directly to loop 30.

In this embodiment, lower end portion 44 is folded back on itself and overlies midsection 46 of elongated strap 40 so as to extend parallel with and in the same direction as front anchor strap portion 18. Lower end portion 44 of elongated strap 40 is attached to front anchor strap portion 18 by any conventional method, such as sewing, heat bonding, adhesive, or the like.

Mating elongated strips of a releasable connecting material, such as hook and loop fastener material or the like, are affixed to facing surfaces of lower end portion 44 and midsection 46 to form an adjustable attachment. One elongated strip 50 (either the hooks or the eyes) is affixed to the inner facing surface of lower end portion 44 by any conventional method, such as sewing, heat bonding, adhesive, or the like. A second mating elongated strip 52 (either the eyes or the hooks) is affixed to the outer facing surface of midsection 46 by any conventional method, such as sewing, heat bonding, adhesive, or the like. Elongated strips 50 and 52 releasably bond to each other in a well known manner to hold adjustable strap 12 fixedly in any desired position. For example, by releasing elongated strips 50 and 52 from each other, moving them up or down relative to each other and reattaching them adjustable strap 12 is quickly and easily shortened or lengthened.

Thus, adjustable strap 12 provides a simple and easily operated adjustment for altering the length of a bra strap. Because adjustable strap 12 is in front it can be easily seen and adjusted while the bra is in position and, therefore, the best and most comfortable possible adjustment can be made. Further, adjustable strap 12 forms a part of the bra strap so that no uncomfortable bulges, joints, or edges are included.

Turning now to FIGS. 5 and 6, another embodiment of an adjustable bra 10' in accordance with the present invention, is illustrated. In this embodiment, all of the components are designated with a prime (') to indicate another embodiment and components similar to components in FIG. 1 are designated with similar numbers. Bra 10' includes two adjustable bra straps only one of which (designated 12') is illustrated in the figures for convenience of understanding. It will be understood that a large variety of shapes and constructions of bras is available and bra 10' is used for illustrative purposes only. At an upper edge of cup 15' front anchor strap portion 18' extends upwardly toward the top of the left shoulder. Similarly, in the back, rear anchor strap portion 22' extends upwardly along the back toward the top of the shoulder.

As illustrated best in FIGS. 5 and 6, an end of rear anchor strap portion 22' extends through a ring 28' and is fold back on itself and attached by sewing or the like. Typically an elongated strap portion 30' is attached at one end to ring 28' and at the other end to a second buckle or ring 32', in a well known manner. In some prior art bras a portion of the strap between portion 30' and rear anchor strap portion 22' is made of elastic material. Also, front anchor strap portion 18' has an upper end that extends through a loop in a dual opening buckle 20' and is fold back on itself and sewn or otherwise attached to securely hold buckle 20'. Dual opening buckle 20' is a common buckle commercially available on the market with a first opening 21' and a second opening 23'. The upper end of front anchor strap portion 18' extends through first opening 21' and around one side post of buckle 20'. In this embodiment, adjustable strap 12' is formed as an elongated double strap forming an elongated continuous loop 40' with an upper portion 42' and a lower portion 44'. To form continuous loop 40', an elongated piece extends through buckle 32' and is folded back on itself, around one side post of buckle 32', to form upper portion 42' and lower portion 44'. Thus, one end of continuous loop 40' is fixed in buckle 32' and, thereby, coupled to the end of elongated strap portion 30'. The end of lower portion 44' extends through first opening 21' of buckle 20' and the end of upper portion 42' extends through second opening 23' of buckle 20'. After passing through buckle 20', the ends of upper portion 42' and lower portion 44' are sewn or otherwise attached together. This attachment around the center post of buckle 20' prevents adjustable strap 12 from coming completely loose from buckle 20'. Upper portion 42' and lower portion 44', as well as any other attachments described herein, may be attached by any conventional method, such as sewing, heat bonding, adhesive, or the like.

Upper portion 42' and lower portion 44' are attached together and extend outwardly from buckle 20' a sufficient distance to form a conveniently accessible attachment section 48'. A fastener including an element and a complemental element is employed to adjustably couple attachment section 48' to upper portion 42'. In this embodiment, mating elongated strips of a releasable connecting material, such as hook and loop fastener material or the like, are affixed to facing surfaces of upper portion 42' and attachment section 48' to form an adjustable attachment. One elongated strip 50' (either the hooks or the eyes) is affixed to the inner or lower facing surface of attachment section 48' by any conventional method, such as sewing, heat bonding, adhesive, or the like. A second mating elongated strip 52' (either the eyes or the hooks) is affixed to the outer facing surface of upper portion 42' by any conventional method, such as sewing, heat bonding, adhesive, or the like. Elongated strips 50' and 52' releasably bond to each other in a well known manner to hold adjustable strap 12' fixedly in any desired position. For example, by releasing elongated strips 50' and 52' from each other, moving them parallel to each other and reattaching them adjustable strap 12' is quickly and easily shortened or lengthened. It should be understood by one skilled in the art that other fasteners which include an element and a complemental element can be used. For example, the fastener can be a hook and eye arrangement wherein the hook is attached to attachment section 48' and a row of eyes is attached to upper portion 42'. These elements can also be reversed if desired. Other fasteners include button and button holes, snap fittings and the like.

Thus, adjustable strap 12' provides a simple and easily operated adjustment for altering the length of a bra strap. Because adjustable strap 12' is in front it can be easily seen and adjusted while the bra is in position and, therefore, the best and most comfortable possible adjustment can be made. Also, adjustable strap 12' extends around the center post of dual buckle 20' so that the buckle is captured between the upper and lower sections and the bra cannot inadvertently come off during adjustments. Further, adjustable strap 12' forms a part of the bra strap so that no uncomfortable bulges, joints, or edges are included. It will be understood that while adjustable strap 12' is illustrated with the adjustable portion adjacent and in communication with front anchor strap portion 18', adjustable strap 12' could be reversed and the adjustable portion placed adjacent buckle 32'. It is also contemplated that an adjustable portion can be adjustably attached adjacent both buckle 20' and 32' or 28'. In this instance, two loop 40' structures may be formed proximate each end of strap 12'. Also, while various rings and buckles have been illustrated in different positions, e.g. ring 32, buckle 32', it should be understood that a large variety of rings and buckles could be used in the various locations and all of these devices are intended to be included in the generic term 'coupler'.

Figure 7:
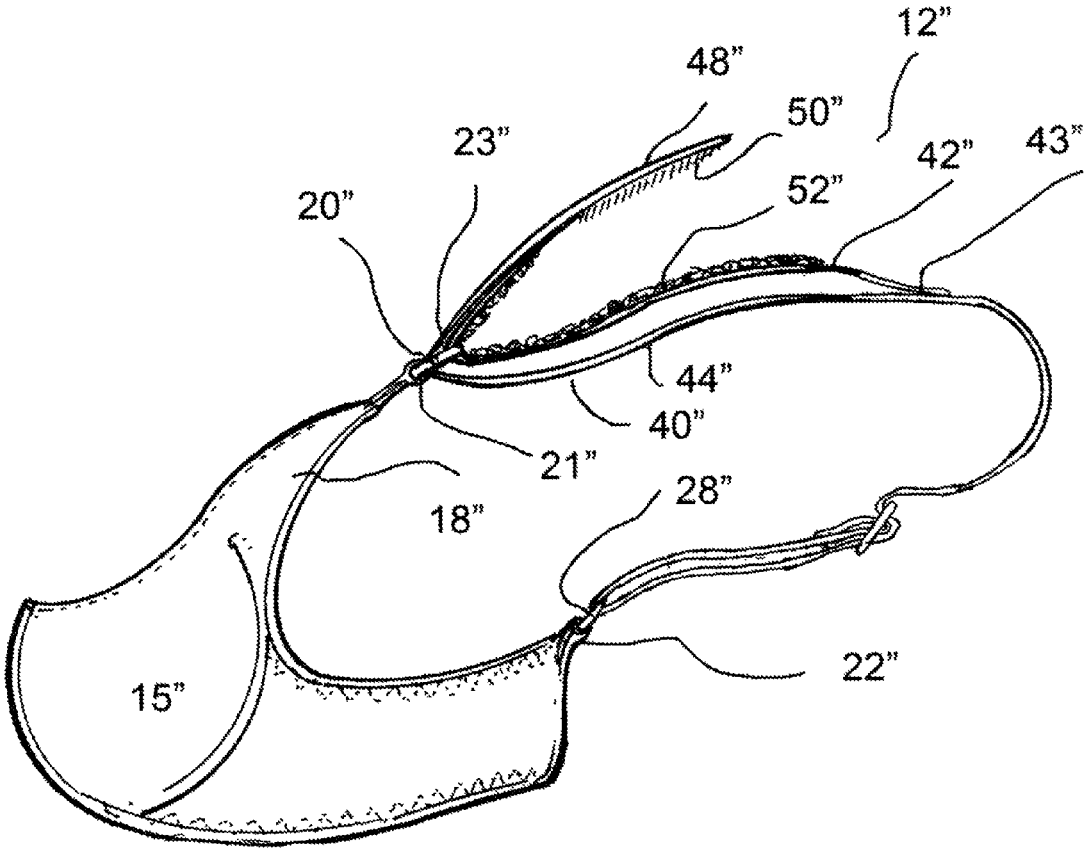
FIG. 7 is an enlarged side view of another embodiment of an adjustable strap according to the present invention.

Referring now to FIG. 7, another arrangement of a bra strap is illustrated. In this embodiment, all of the components are designated with a double prime (") to indicate another embodiment, and components similar to components in FIG. 6 are designated with similar numbers. Bra 10" includes two adjustable bra straps only one of which (designated 12") is illustrated in the figure for convenience of understanding. It will be understood that a large variety of shapes and constructions of bras is available and bra 10" is used for illustrative purposes only. At an upper edge of cup 15" front anchor strap portion 18" extends upwardly toward the top of the left shoulder. Similarly, in the back, rear anchor strap portion 22" extends upwardly along the back toward the top of the shoulder.

In this embodiment, adjustable strap 12" includes an elongated loop 40" formed at an end thereof. Elongated loop 40" has an upper portion 42" and a lower portion 44". To form continuous loop 40", in this embodiment, upper portion 42" is fastened to lower portion 44" at seam 43. Loop 40" can be formed by an elongated piece extending through buckle 20" and folded back on itself and attached at seam 43, to form upper portion 42" and lower portion 44" (FIG. 7), or upper portion 42" can be a separate piece of material fastened to lower portion 44" at each end to form loop 40".

Lower portion 44" extends through first opening 21" of buckle 20" and upper portion 42" extends through second opening 23" of buckle 20". After passing through buckle 20", the ends of upper portion 42" and lower portion 44" are sewn or otherwise attached together, or formed by an elongate piece doubled back on itself as described previously. This attachment around the center post of buckle 20" prevents adjustable strap 12" from coming completely loose from buckle 20". Upper portion 42" and lower portion 44", as well as any other attachments described herein, may be attached by any conventional method, such as sewing, heat bonding, adhesive, or the like. An opposing end of adjustable strap 12" extends through an adjustment buckle 32", well known in the art, to allow conventional adjustment.

Upper portion 42" and lower portion 44" are attached together (or are formed by a folded length of material) and extend outwardly from buckle 20" a sufficient distance to form a conveniently accessible attachment section 48". A fastener including an element and a complemental element is employed to adjustably couple attachment section 48" to upper portion 42". In this embodiment, mating elongated strips of a releasable connecting material, such as hook and loop fastener material or the like, are affixed to facing surfaces of upper portion 42" and attachment section 48" to form an adjustable attachment. One elongated strip 50" (either the hooks or the eyes) is affixed to the inner or lower facing surface of attachment section 48" by any conventional method, such as sewing, heat bonding, adhesive, or the like. A second mating elongated strip 52" (either the eyes or the hooks) is affixed to the outer facing surface of upper portion 42" by any conventional method, such as sewing, heat bonding, adhesive, or the like. Elongated strips 50" and 52" releasably bond to each other in a well known manner to hold adjustable strap 12" fixedly in any desired position. For example, by releasing elongated strips 50" and 52" from each other, moving them parallel to each other and reattaching them, adjustable strap 12" is quickly and easily shortened or lengthened. It should be understood by one skilled in the art that other fasteners which include an element and a complemental element can be used. For example, the fastener can be a hook and eye arrangement wherein the hook is attached to attachment section 48" and a row of eyes is attached to upper portion 42". These elements can also be reversed if desired. Other fasteners include button and button holes, snap fittings and the like.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. In combination with a bra having a front anchor strap portion extending upwardly from a cup and a rear anchor strap portion extending upwardly from a rear strap, an adjustable bra shoulder strap comprising:

an elongated enclosed loop of flexible fabric having a first end and a second end, one of the first end and the second end forming an attachment section;

a first coupler coupling one of the first end and the second end of the elongated enclosed loop to the rear anchor strap portion;

a second coupler coupling another of the first end and the second end of the elongated enclosed loop to the front anchor strap portion;

the elongated enclosed loop extending through one of the first coupler and the second coupler with the one of the first coupler and the second coupler being movable longitudinally along one side of the elongated enclosed loop at least partially between the first end and the second end; and a fastener element carried by the attachment section and a complemental fastener element carried by a facing portion of the elongated enclosed loop, the attachment section of the elongated enclosed loop positioned adjacent one of the first coupler and the second coupler, the fastener element being positioned to mate with and releasably connect to the complemental fastener element in a selected orientation on an opposing side of one of the first coupler and the second coupler.

2. An adjustable bra shoulder strap as claimed in claim 1 wherein the fastener element is a strip of releasable connecting material affixed to one surface of the attachment section and the complemental fastener element is a mating strip of releasable connecting material affixed to a facing surface of the elongated enclosed loop.

3. An adjustable bra shoulder strap as claimed in claim 1 wherein the first end of the elongated enclosed loop extends into the attachment section.

4. An adjustable bra shoulder strap as claimed in claim 3 wherein the first end of the elongated enclosed loop is coupled by the second coupler to the front anchor strap portion.

5. An adjustable bra shoulder strap as claimed in claim 1 further including an elongated strap portion coupling the first coupler to the rear anchor strap portion so as to position the elongated attachment section of the elongated enclosed loop in front of a wearer's shoulder.

6. In combination with a bra having a front anchor strap portion extending upwardly from a cup and a rear anchor strap portion extending upwardly from a rear strap, an adjustable bra shoulder strap comprising:

an elongated enclosed loop of flexible fabric having a first end and a second end, one of the first end and the second end being an attachment section;

an elongated strap portion coupling a first coupler to the rear anchor strap portion so as to position the first coupler in front of a wearer's shoulder, the first coupler coupling one of the first end and the second end of the elongated enclosed loop to the elongated strap portion;

a second coupler coupling another of the first end and the second end of the elongated enclosed loop to the front anchor strap portion;

the elongated enclosed loop extending through one of the first coupler and the second coupler with the one of the first coupler and the second coupler being movable longitudinally along one side of the elongated enclosed loop at least partially between the first end and the second end; and a fastener element carried by the attachment section and a complemental fastener element carried by a facing portion of the elongated enclosed loop, the attachment section of the elongated enclosed loop positioned adjacent one of the first coupler and the second coupler, the fastener element being positioned to mate with and releasably connect to the complemental fastener element in a selected orientation on an opposing side of one of the first coupler and the second coupler, whereby the selected orientation is changed by longitudinal movement of the one of the first coupler and the second coupler along one side of the elongated enclosed loop.

7. In combination with a bra having a front anchor strap portion extending upwardly from a cup and a rear anchor strap portion extending upwardly from a rear strap, an adjustable bra shoulder strap comprising:

an elongated enclosed loop of flexible fabric having a first end and a second end, the first end forming an attachment section;

an elongated strap portion extending from the second end of the elongated enclosed loop, the elongated strap portion coupling the second end of the elongated enclosed loop to rear anchor strap portion;

a coupler coupling the first end of the elongated enclosed loop to the front anchor strap portion;

the elongated enclosed loop extending through the coupler with the coupler being movable longitudinally along one side of the elongated enclosed loop at least partially between the first end and the second end; and a fastener element carried by the attachment section and a complemental fastener element carried by a facing portion of the elongated enclosed loop, the attachment section of the elongated enclosed loop positioned on one side of the coupler, the fastener element being positioned to mate with and releasably connect to the complemental fastener element in a selected orientation on an opposing side of the coupler, whereby the selected orientation is changed by longitudinal movement of the coupler along one side of the elongated enclosed loop.

8. An adjustable bra shoulder strap as claimed in claim 7 wherein the fastener element is a strip of releasable connecting material affixed to one surface of the attachment section and the complemental fastener element is a mating strip of releasable connecting material affixed to a facing surface of the elongated enclosed loop.

* * * * *